United States Patent [19]

Rinaldi et al.

[11] 4,382,695

[45] May 10, 1983

[54] THIN MOVEMENT FOR STEPPING MOTOR WATCH

[75] Inventors: Joseph Rinaldi; Paul Wuthrich, both of Watertown, Conn.

[73] Assignee: Timex Corporation, Waterbury, Conn.

[21] Appl. No.: 275,469

[22] Filed: Jun. 19, 1981

[51] Int. Cl.[3] ..... G04B 19/02; G04B 29/00

[52] U.S. Cl. ..... 368/220; 368/76; 368/80; 368/324

[58] Field of Search ..... 368/76, 80, 220, 322, 368/324

[56] References Cited

U.S. PATENT DOCUMENTS

| | | | |
|---|---|---|---|
| 4,079,582 | 3/1978 | Tamaru et al. | 368/76 |
| 4,104,859 | 8/1978 | Ogihara et al. | 368/220 |
| 4,249,251 | 2/1981 | Wuthrich | 368/76 |

FOREIGN PATENT DOCUMENTS

| | | | |
|---|---|---|---|
| 52-46847 | 4/1977 | Japan | 368/220 |
| 8564 | 7/1977 | Switzerland | 368/76 |

*Primary Examiner*—Bernard Roskoski

*Attorney, Agent, or Firm*—William C. Crutcher

[57] ABSTRACT

A thin movement for a stepping motor watch employs a single frame member a peripheral front frame portion surrounding and connected to a back frame portion and stepping motor stator, affixed to the frame member, pins fixed in the back frame portion and stepping motor stator, gear members including the stepping motor rotor and gear train driving the watch hands rotatably mounted on said pins, a dial for the timepiece supported on the front frame portion, the dial serving to control axial movement of the gear members on the pins. Only two layers of gear members are required in the space between the back frame portion and the dial.

7 Claims, 2 Drawing Figures

THIN MOVEMENT FOR STEPPING MOTOR WATCH

This invention relates generally to movements for very thin timepieces, and particularly to a thin movement suitable for a stepping motor watch of the quartz analog type. The substitution of an integrated circuit, a quartz crystal timebase, and a stepping motor driving the timepiece hands has reduced the number of components in wristwatches and offered opportunities for simplifying construction and reducing the number of components. A very thin wristwatch also offers improved aesthetic values and flexibility in design.

Any timepiece with rotatable members, such as the stepping motor rotor, gear train and the hour and minute wheel assembly carrying the timepiece hands, must maintain proper axial clearance of the rotatable members so that they will neither bind nor have excessive axial play. The axial movement of the rotatable members is sometimes known as "endshake" and its proper control in high-volume, mass-produced timepieces is vital to successful control of the manufacturing process and timepiece quality.

In my U.S. Pat. No. 4,249,251 issued Feb. 3, 1981, for a "Gear Train for Timepiece with a Stepping Motor" and assigned to the present assignee, a timepiece movement construction is shown, wherein a single piece frame member of plastic material supports a dial which controls the "endshake" of an intermediate gear assembly journaled on a rotatable pin held in a journal bearing in the back of a plastic frame member. In that watch movement, the axial movement of the minute and hour wheel assembly was controlled by a conventional spring washer, while the axial movement of the stepping motor rotor was controlled between the stepping motor stator and the frame. In that patent, the rotatable members included supporting pins of special shape which also rotated in bores in the plastic frame member. The gear train arrangement required three layers of gear members, which, together with the required thickness of the plastic frame added to the overall timepiece thickness.

Many efforts have been made to reduce the thickness and reduce the number of components in electronic timepieces. Exemplary of the prior art also is U.S. Pat. No. 4,079,582 issued Mar. 21, 1978, to Tamaru et. al., in which fixed pins in the back frame portion carry the rotatable gear members in the space between the back frame portion and the dial. However, since the Tamaru pins do not contact the dial, flexing or distortion of the dial in the vicinity of the rotatable gear member thereby might effect endshake control of the gear member.

Accordingly, one object of the present invention is to provide an improved thin movement for a timepiece, with improved means for controlling the endshake of the gear members.

Another object of the invention is to provide an improved construction for controlling the endshake of the stepping motor rotor in a thin timepiece movement.

Another object of the invention is to provide an improved construction for controlling the endshake of the hour and minute wheel assembly in a thin movement for a timepiece.

Still another object of the invention is to provide a thin movement for stepping motor timepiece with a one-piece frame member, having no more than two layers of gear members between frame member and dial.

DRAWINGS

The invention, both as to organization and method of practice, together with further objects and advantages thereof, will best be understood by reference to the following specification, taken in connection with the accompanying drawings, in which.

SUMMARY OF THE INVENTION

Briefly stated, the invention is practiced by providing a timepiece movement comprising a single frame member with a peripheral front frame portion connected to and at least partially surrounding a back frame portion, said front and back frame portions having surfaces disposed in parallel spaced planes, a plurality of pins having one end fixed in said back frame portion and the other end terminating substantially in the plane of the front frame portion surface, a plurality of gear members mounted on said pins, a dial disposed on the front surface and contacting the terminating ends of said pins and limiting the axial movements of said gear members on the pins. An additional pin may be used in the stepping motor stator to support the stepping motor rotor, which also has its endshake controlled by the dial.

DESCRIPTION OF THE PREFERRED EMBODIMENT

Figure 1:
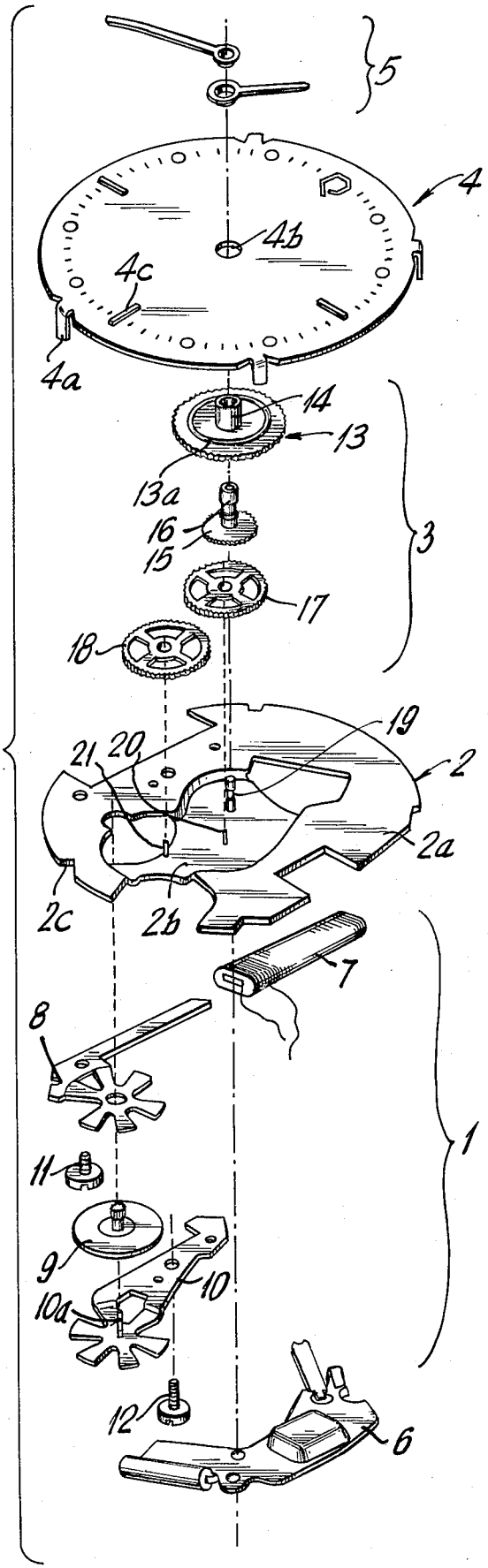
FIG. 1 is an exploded perspective view of the timepiece movement.

Referring now to FIG. 1 of the drawing, the major components of the movement are the stepping motor assembly designated by brackets as reference 1, a single piece frame member 2, a train of rotatable gear members designated as 3, a timepiece dial 4, and the timepiece hands 5. The electronic components are arranged on a circuit board 6. Not shown in the drawing are the timepiece case, which may be of conventional construction, push button switches to actuate the electrical circuitry for setting the timepiece, and a button-sized energy cell to provide power.

The components of the stepping motor assembly 1 are a coil 7, a front stator member 8, a permanent magnet rotor and pinion assembly 9, a back stator member 10, with screws 11, 12 which securely attach the stator members 8, 10 to the frame member 2. The rotatable gear member assembly includes an hour wheel 13 with attached sleeve 14, a minute wheel with attached sleeve 16 arranged to fit coaxially within sleeve 14, a third wheel gear and pinion assembly 17, and an intermediate gear and pinion assembly 18.

The frame member 2 is stamped from a single sheet of metal and comprises a peripheral front frame portion **2*a* connected to and at least partially surrounding a back frame portion 2*b*. The front and back frame portions 2*a*, 2*b* are formed with surfaces disposed in spaced parallel planes. The front frame portion includes notches such as 2*c* disposed to receive tabs such as 4*a* on the dial. These permit the dial to be affixed to the frame member as the movement is assembled, by bending tabs 4*a* on the dial beneath the frame member. The dial also includes a central hole 4*b* and time indicating markers 4*c***.

The rotatable gear members are journaled upon non-rotatable or fixed pins, which include a stator pin **10*a* on the back stator member 10, a center post 19, and a plurality of pins 20, 21 supporting the third wheel assembly 17 and the intermediate wheel assembly 18, respectively. When assembled, the pins 20, 21, rotor pin 10***a* and center post 19 are fixed securely at one end to the stator and back frame portion. The other ends of pins 10*a*, 20, 21 terminate in the plane which contains the front frame surface 2*a*, while the center post 19 projects above this plane. It remains to note that the hour wheel 13 includes a peripheral ridge 13*a* which cooperates with the underside of dial 4 to control endshake as will be explained.

Figure 2:
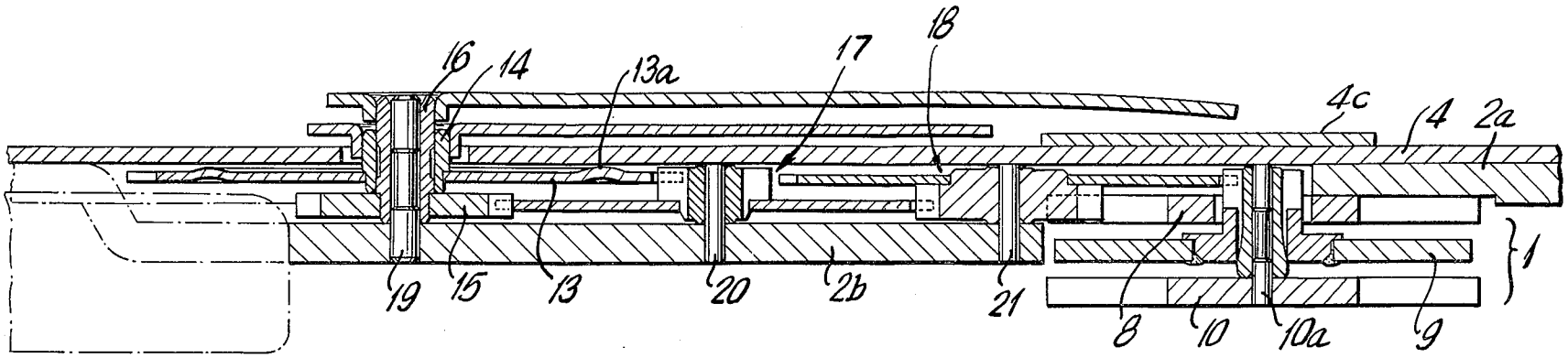
FIG. 2 is a developed partial horizontal cross-section of the improved movement.

Referring now to FIG. 2 of the drawing, a developed partial elevation drawing in cross-section illustrates the principle of construction and operation of the improved thin movement for a stepping motor timepiece. The single piece frame member front and back portions 2*a*, 2*b* are seen to contain top surfaces 2*c*, 2*d*, respectively, disposed in two parallel spaced planes. When the timepiece is assembled, the stepping motor assembly 1 is attached from the rear with screws 11, 12 as indicated, with the stepping motor rotor pin 10*a* having a terminating free end disposed in the front plane. The pins 20, 21, and center post 19 have one end fixed in the rear frame portion 2*b*. Pins 20, 21 have free ends disposed in the front surface plane, which post 19 extends beyond the plane.

The third wheel and intermediate wheel gear and pinion assemblies 17, 18 are assembled from the front of the timepiece on pins 20, 21 and the hour and minute wheel assemblies 13, 14, 15, 16 are assembled on the center post 19, all from the front of the watch. Dial 4 is affixed to the front frame portion 2*a* and contacts the ends of pins 20, 21, 10*a*. Since the spacing between the dial 4 and the back frame 2*a* (or stator 10) is now accurately set, the endshake for axial movement of the stepping motor rotor and pinion assembly 9 and the third wheel and intermediate gear assemblies 17, 18 are accurately controlled.

In the case of the coaxially mounted hour wheel and minute wheel sleeves 14, 16, the endshake or axial movement of the two assemblies is controlled by the ridge 13*a* on hour wheel 13, which forms close clearances with the dial. Since the hour wheel is a very slow moving wheel, the friction induced by this contact is negligible.

It is important to note also that the resulting gear train arrangement has no more than two layers of gear members in the space between the back frame portion and the dial. Therefore, an extremely thin movement is possible which is simple to assemble and yet with assurance of accurate endshake control.

While there has been described herein the preferred embodiment of the invention, it is desired to encompass in the appended claims all such modifications as fall within the true spirit and scope of the invention.

What is claimed is:

1. An improved movement for a thin timepiece of the type having a stepping motor with a rotor driving timepiece hands through an intermediate gear train, the improvement comprising:

(a) a frame member comprising a sheet metal stamping having a peripheral front frame portion connected to and at least partially surrounding a back frame portion, said front and back frame portions having surfaces disposed in parallel spaced planes, (b) a plurality of non-rotatable pins each having one end fixed in the frame back portion and the other end terminating substantially at the front frame surface plane, (c) a plurality of gear members rotatably mounted on said pins, said gear members comprising an intermediate gear and pinion assembly driven by said rotor, and a third wheel gear and pinion assembly driven by said intermediate assembly, and (d) a dial for the timepiece supported on the front frame surface portion and contacting the terminating ends of said pins and controlling the axial movements of said rotatable gear members on said pins.

2. The combination according to claim 1, further including a stator member for the stepping motor affixed to said frame member and carrying a fixed stator pin having a free end terminating at the front surface plane, and a stepping motor rotor disposed on said pin, whereby the axial movement of the stepping motor rotor is controlled by said dial.

3. The combination according to claim 1, and further including a center post affixed at one end to the back frame portion and projecting through a hole defined in the dial, and further including coaxial hour and minute wheel assemblies rotatably mounted on said center post, said hour wheel defining a peripheral ridge adapted to form close clearances with the dial to thereby control endshake of the hour and minute wheel assemblies.

4. The combination according to claim 1, wherein said dial and said back frame portion define therebetween a space containing the rotatable gear members, said gear members comprising no more than two layers of gears disposed in said space, whereby the thickness of the movement may be minimized.

5. The combination according to claim 1, including a stator for the stepping motor carrying a pin supporting the stepping motor rotor, and further including a center post rotatably supporting coaxial hour and minute wheel assemblies, said rotor, said gear members and said hour and minute wheel assemblies all being adapted to cooperate with said timepiece dial to control endshake.

6. An improved movement for a thin timepiece of the type having a stepping motor with a rotor driving timepiece hands through an intermediate gear train, said improvement comprising:

(a) a single stamped metal frame member having a peripheral front frame portion connected to and at least partially surrounding a back frame portion, said front and back frame portions having surfaces disposed in parallel spaced planes, (b) a stepping motor stator affixed to said frame member and having a stator pin affixed at one end to the stator and terminating in the front frame surface plane, (c) a plurality of pins affixed at one end in the back frame portion and having ends terminating in the front frame surface plane, (d) an intermediate gear and pinion assembly disposed on one of said pins and adapted to be driven by the rotor, (e) a third wheel gear and pinion assembly disposed on another of said pins meshing with and adapted to be driven by the intermediate gear and pinion assembly, (f) a center post having one end affixed in the back frame portion and extending past said plane, (g) coaxial minute wheel assembly and hour wheel assembly meshing with and driven by said third gear and pinion assembly, and (h) a dial disposed on the front frame portion and affixed thereto and defining a center hole to receive the center post, said dial contacting the free ends of said pins and controlling endshake of the stepping motor rotor, the intermediate gear and pinion assembly and the third gear and pinion assembly.

7. The combination according to claim 6, wherein said hour wheel defines a peripheral ridge thereon adapted to form close clearances with said dial to thereby control the endshake of the hour wheel and minute wheel assemblies.

* * * * *